US008662786B2

(12) United States Patent
Seeglitz et al.

(10) Patent No.: US 8,662,786 B2
(45) Date of Patent: Mar. 4, 2014

(54) APPARATUSES, SYSTEMS AND METHODS FOR AFFECTING FORWARD MOTION OF A VEHICLE

(75) Inventors: William Grant Seeglitz, Glendale, AZ (US); Mynor J. Castro, Chandler, AZ (US); Robert Arthur Mccoy, Phoenix, AZ (US); Edwin Allen Spomer, Peoria, AZ (US); Michael David Williams, Gilbert, AZ (US)

(73) Assignee: Pacific Scientific Energetic Materials Company (Arizona) LLC, Chandler, AZ (US)

( * ) Notice: Subject to any disclaimer, the term of this patent is extended or adjusted under 35 U.S.C. 154(b) by 289 days.

(21) Appl. No.: 12/611,771

(22) Filed: Nov. 3, 2009

(65) Prior Publication Data

US 2010/0196093 A1 Aug. 5, 2010

Related U.S. Application Data

(60) Provisional application No. 61/110,882, filed on Nov. 3, 2008.

(51) Int. Cl.
*E01F 13/12* (2006.01)

(52) U.S. Cl.
USPC ..... 404/6; 14/69.5

(58) Field of Classification Search
USPC ..... 404/6, 9–11; 14/69.5, 71.1
See application file for complete search history.

(56) References Cited

U.S. PATENT DOCUMENTS

| | | | | |
|---|---|---|---|---|
| 4,332,503 | A * | 6/1982 | Hurst, Jr. | 404/11 |
| 4,627,763 | A * | 12/1986 | Roemer et al. | 404/6 |
| 4,687,370 | A | 8/1987 | Knowles | |
| 4,850,737 | A * | 7/1989 | Nasatka et al. | 404/6 |
| RE33,201 | E * | 4/1990 | Dickinson | 404/6 |
| 4,974,991 | A | 12/1990 | Mandavi | |
| 6,010,277 | A * | 1/2000 | Follman | 404/11 |
| 6,224,291 | B1 | 5/2001 | Mateychuk | |
| 7,114,873 | B2 | 10/2006 | Rastegar et al. | |
| 7,645,090 | B2 * | 1/2010 | Rastegar et al. | 404/15 |
| 2006/0218731 | A1 * | 10/2006 | Muhl et al. | 14/71.3 |

OTHER PUBLICATIONS

Video Grab, Kia Car stunt team—YouTube time 2 min. 11 secs. May 27, 2006; http://youtube.com/watch?v=B1RArcjTp5U.*

International Search Report and Written Opinion; International Application No. PCT/US2009/063150; filed Nov. 3, 2009; Applicant Pacific Scientific Energetic Materials Company; dated Dec. 16, 2009; 11 pages.

* cited by examiner

*Primary Examiner* — Raymond W Addie
(74) *Attorney, Agent, or Firm* — Perkins Coie LLP

(57) ABSTRACT

A vehicle destabilizing device that provides for the selective, remotely-deployed deflection and/or overturning of a targeted vehicle regardless of wheel or undercarriage configuration. The device is comprised of a combination of a remote arm/safe mechanism, a remote deployment switch, one or more lifting devices, a housing, and one or more structural members contiguously engaging the vehicle. The housing can be at least partially submerged in a road surface or protrude from the road surface so as to be driven over until deployed. A sensor can provide independent deployment once the device is armed.

15 Claims, 12 Drawing Sheets

APPARATUSES, SYSTEMS AND METHODS FOR AFFECTING FORWARD MOTION OF A VEHICLE

CROSS-REFERENCE TO RELATED APPLICATION(S)

This patent application claims the benefit under 35 U.S.C. §119 of U.S. Provisional Patent Application No. 61/110,882, filed on Nov. 3, 2008, entitled "Vehicle Destabilization Devices and Methods for Arresting Forward Motion." That application is incorporated herein in its entirety by reference.

TECHNICAL FIELD

The present disclosure relates generally to systems and methods for affecting the forward motion of a land vehicle. In particular, the present disclosure relates to systems and methods for destabilizing a moving land vehicle and causing the vehicle to overturn or deflect so as to affect the forward motion of the vehicle. The present disclosure also relates to systems and methods for damaging the chassis of a moving vehicle so as to affect the ability of the vehicle to continue moving.

DETAILED DESCRIPTION

Overview

Figure 1A:
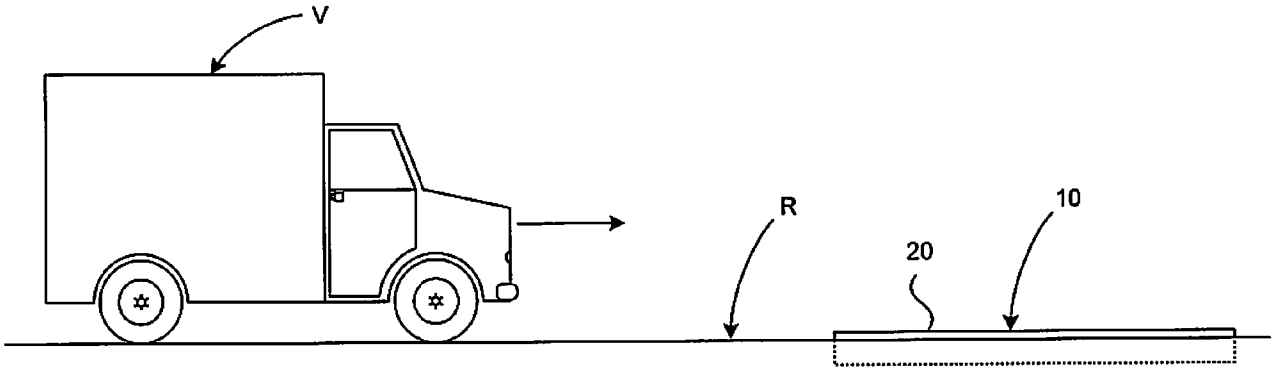
FIG. 1A is a schematic side view illustrating a stowed configuration of a vehicle destabilizing device in accordance with several embodiments of the present disclosure.

The following describes embodiments of vehicle destabilizing devices and methods of destabilizing vehicles in accordance with the present disclosure. Embodiments in accordance with the present disclosure are set forth in the following text to provide a thorough understanding and enabling description of a number of particular embodiments. Numerous specific details of various embodiments are described below with reference to destabilization devices for vehicles having wheels engaging a paved surface, but embodiments can be used with other types of terrain (e.g., dirt, gravel, and other non-paved surfaces). In some instances, well-known structures or operations are not shown, or are not described in detail to avoid obscuring aspects of the inventive subject matter associated with the accompanying disclosure. A person skilled in the art will understand, however, that the invention may have additional embodiments, or that the invention may be practiced without one or more of the specific details of the embodiments as shown and described.

According to several embodiments of the present disclosure, a device for destabilizing a moving vehicle causes the vehicle to overturn or deflect so as to affect its forward motion. Certain embodiments according to the present disclosure are directed to overturning, deflecting and/or damaging forward moving vehicles weighing up to 75,000 pounds and moving up to 75 miles per hour.

Certain embodiments of a system for affecting the forward movement of a vehicle may include two actuators by which first and second wheels on the same side of the vehicle are lifted. Certain other embodiments according to the present disclosure may include a single actuator for engaging only one of the wheels on one side of the vehicle. In still other embodiments, a single actuator can be configured to lift all of the wheels on one side of the vehicle. In yet other embodiments more than two actuators can be used, e.g., on target vehicles having more than two axles.

In certain embodiments, a system for affecting the forward movement of a vehicle on a surface may lift the wheels and/or chassis of a targeted moving vehicle to destabilize, deflect and/or overturn the vehicle as it travels along a path. An aspect of a system for affecting the forward movement of a vehicle includes a housing that has been installed or otherwise placed in the ground or on a road surface in the path of a targeted vehicle. As the vehicle is driven over the housing, a lifting force is applied to one side of the vehicle, one wheel of the vehicle, a plurality of wheels on one side of the vehicle, the chassis on one side of the vehicle, etc. The lifting force destabilizes the vehicle by shifting the vehicle's center of gravity and thereby causes the vehicle to tip-over and/or deflect the forward motion of the vehicle.

Another aspect of certain embodiments of a system for affecting the forward movement of a vehicle may include being selectively armed and/or disarmed. When disarmed or safe, the system is placed into a "sleep" or "deactivated"

mode in which vehicles may drive over the housing without consequence, much like a conventional speed bump. When the system is armed, however, the system will destabilize, deflect and/or overturn the next vehicle that drives across the housing. As hereinafter described, the system can be selectively armed and disarmed remotely via wired or wireless communication from a vehicle sensor and/or an operator controlled device.

Still another aspect of certain embodiments of a system for affecting the forward movement of a vehicle may include one or more actuators, which may include pneumatic actuators, hydraulic actuators, energetic actuators, and/or any suitably actuator that can be positioned between the housing and a ramp. When the system is armed and a target vehicle is detected, one or more actuators are actuated to rapidly lift the ramp on one side of the vehicle. Accordingly, a center of gravity of the vehicle is rapidly shifted as one side of the vehicle climbs the ramp. This introduces a vehicle tipping moment that can destabilize, deflect, overturn and/or otherwise affect the forward movement of the vehicle.

In some embodiments, an apparatus may shift a center of gravity of a moving vehicle to affect forward movement of the vehicle on a surface. The vehicle includes a wheel and a chassis. An aspect of such an apparatus may include a housing configured to be positioned in a path of the vehicle, a destabilizing member that is deployed from the housing, and a lifting device configured to lift the destabilizing member with respect to the housing. The destabilizing member is configured to lift one side of the vehicle.

In some other embodiments, a system may provide selective, remotely deployed destabilization of a moving vehicle. An aspect of such a system may include a housing configured to rest on a surface, a structural member configured to contiguously engage the moving vehicle, a lifting device configured to lift the structural member with respect to the housing, a safe/arm device, and a remote deployment device configured to actuate the lifting device to lift the structural member with respect to the housing. The safe/arm device has (a) a safe arrangement configured to prevent the lifting device from lifting the structural member with respect to the housing; and (b) an armed arrangement configured to permit the lifting device to lift the structural member with respect to the housing.

In still other embodiments, a method may affect forward movement of a vehicle on a surface. The vehicle includes a wheel. An aspect of such a method may include raising a ramp to an inclined arrangement with respect to a housing, locking the ramp in the inclined arrangement with respect to the housing, and shifting a center of gravity of the vehicle. Shifting the center of gravity of the vehicle includes (a) launching the wheel of the vehicle up the ramp locked in the inclined arrangement with respect to the housing; and (b) lifting one side of the vehicle. The one side of the vehicle has the wheel.

Apparatuses, Systems and Methods for Affecting Forward Motion of a Vehicle

Figure 1B:
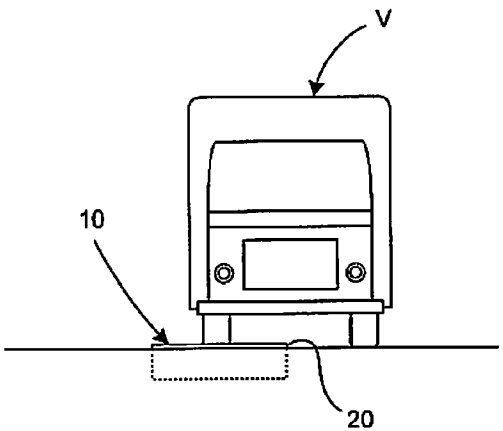
FIG. 1B is a schematic front view illustrating the stowed configuration of the vehicle destabilizing device shown in FIG. 1A.

FIGS. 1A and 1B are schematic side and front views, respectively, illustrating a first or stowed configuration of a vehicle destabilizing device 10 in accordance with several embodiments of the present disclosure. In the stowed configuration shown in FIGS. 1A and 1B, the device 10 can be packaged in a housing 20. The housing 20, which can possibly be reused, repackaged, or be recharged, is positioned in the path of an oncoming target vehicle V.

In the embodiment shown in FIGS. 1A and 1B, the housing 20 is configured as a road protuberance that at least partially protrudes above a road surface R. Such protuberances are typically referred to as a "speed bump" (also referred to as a "speed hump," "road hump" or "sleeping policeman"). In other embodiments, the housing 20 may be laid on top of the road surface R. In still other embodiments, the housing 20 may be configured to be installed in a cut-away so as to be flush with the road surface R. In any event, the housing 20 may be configured such that its capability for vehicle destabilization is concealed from a driver of an oncoming target vehicle.

In the embodiment shown in FIG. 1, the device 10 is deployed under the vehicle V. In certain embodiments, the device 10 can be permanently coupled in or on the road surface R in a regular path way of traffic, or the device can be deployed from the side of the road surface R.

Figure 2:
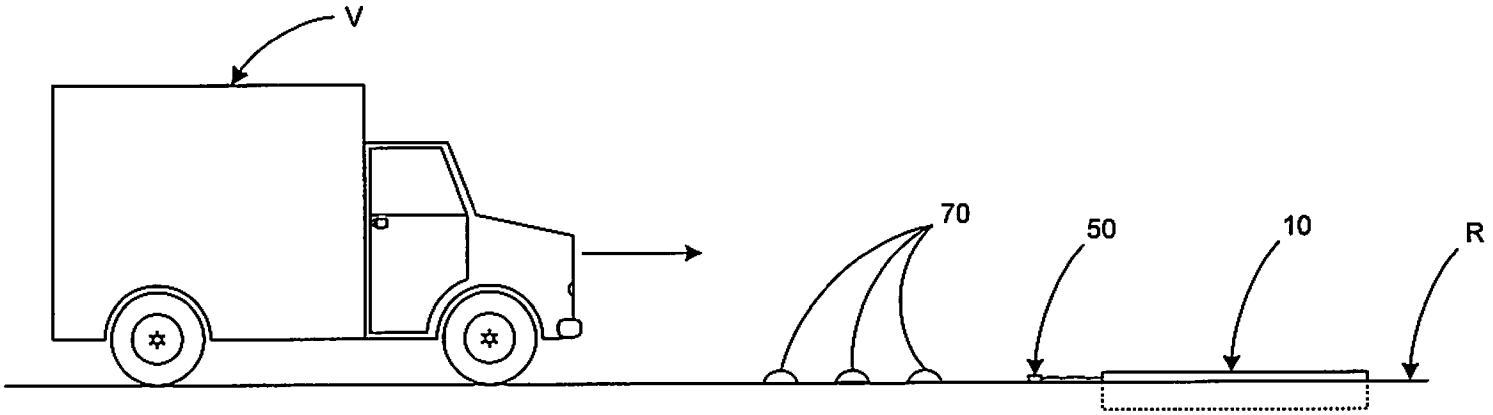
FIG. 2 is a schematic side view illustrating a system for destabilizing a vehicle in accordance with several embodiments of the present disclosure.

FIG. 2 is a schematic side view illustrating a system, including the vehicle destabilizing device 10, for arresting the forward motion of the vehicle V in accordance with several embodiments of the present disclosure. A sensor 50 is shown disposed in front of the device 10, e.g., between the oncoming vehicle V and the device 10.

The sensor 50 can be used to determine the presence of the vehicle V. For example, the sensor 50 can determine the presence of one or more characteristics of a vehicle including mass, heat, sound, electromagnetic field, vibration, motion, or another suitable property. The device 10 can be remotely armed and the sensor 50 can detect the proximity of an oncoming vehicle to initiate the deployment sequence.

According to other embodiments of the present disclosure, individual sensors can be disposed on or inside the housing 20. For example, a proximity sensor can send an electrical signal to a pyrotechnical actuator, or another suitable sensor can signal a corresponding suitable actuator.

In the embodiment shown in FIG. 2, at least one upsetting bump 70, e.g., a speed bump or a speed dot can be positioned in front of the sensor 50. The upsetting bumps 70, three are shown in FIG. 2, can be placed prior to the device 10 to aid in disrupting the forward motion of the vehicle V, e.g., by upsetting the vehicle V as it approaches the destabilizing device 10. In other embodiments, the upsetting bump(s) 70 can be omitted.

Figure 3A:
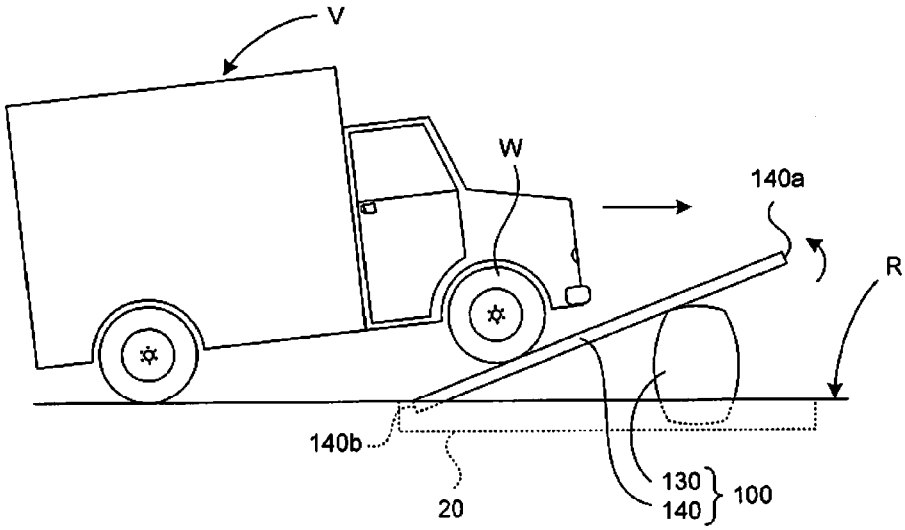
FIG. 3A is a schematic side view illustrating a deployed configuration of a vehicle destabilizing device in accordance with a first embodiment of the present disclosure.
Figure 3B:
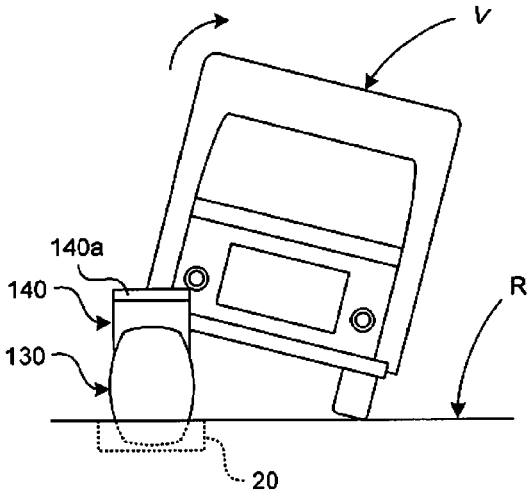
FIG. 3B is a schematic front view illustrating the deployed configuration of the vehicle destabilizing device shown in FIG. 3A.

FIGS. 3A and 3B are schematic side and front views, respectively, illustrating a second or deployed configuration of a vehicle destabilizing device 100 in accordance with a first embodiment of the present disclosure. The vehicle destabilizing device 100 includes a lift device 130 and a ramp 140.

In the embodiment shown in FIGS. 3A and 3B, a lift device 130 raises a trailing end 140*a* of the ramp 140, which acts on one wheel W to create lift on one side of the vehicle V. The lift device 130 can include a piston actuator, an inflatable actuator, a hydraulic actuator, a pneumatic actuator, an energetic actuator (e.g., a pyrotechnical device), or any actuator suitable for raising the ramp 140 up from the road surface R. The ramp 140 can include any suitable structural member and can have a leading end 140*b* pivotally coupled to the housing 20. Alternatively, the leading end 140*b* can be freely disposed relative to the housing 20.

The device 100 is positioned on one side of the road surface R to lift the wheel W on one side of the vehicle V. Lifting one side of a vehicle in motion deflects and/or destabilizes the center of gravity of the moving vehicle, thereby causing the vehicle's forward momentum to be deflected and causing the vehicle to tip over or overturn. In certain embodiments, two or more actuators can lift the trailing ends of corresponding ramps so as to lift individual wheels on the same side of a vehicle.

In accordance with one embodiment of the present disclosure, the lift device 130 can include a pneumatically actuated air bag. The air bag expands in approximately 30 milliseconds and exerts up to approximately 100,000 pounds of force in raising the trailing end 140*b* approximately 30 inches above the road surface R. Such an arrangement can overturn and/or deflect the forward motion of a vehicle weighing up to approximately 30 tons that is moving up to approximately 50 to 60 miles-per-hour.

Figure 4A:
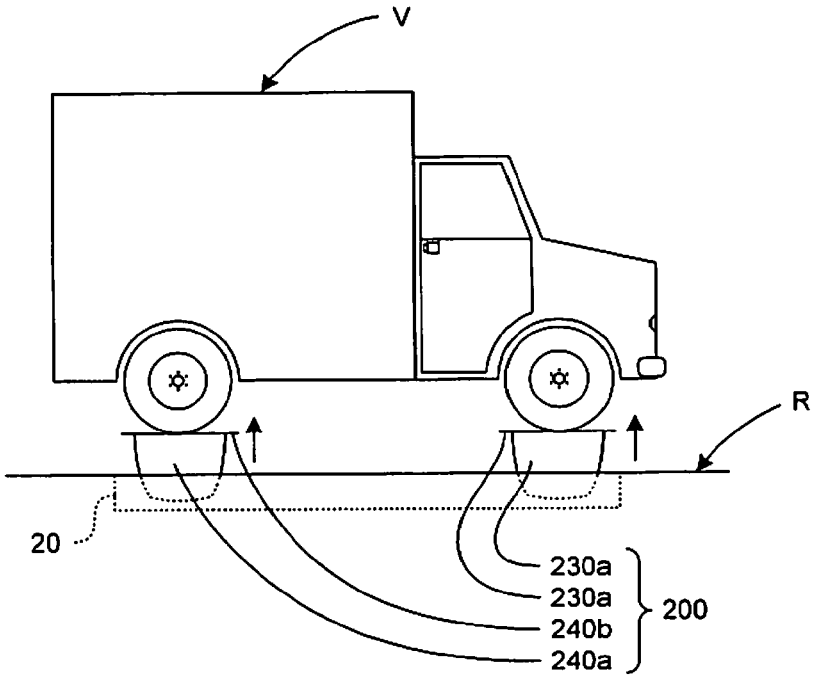
FIG. 4A is a schematic side view illustrating a deployed configuration of a vehicle destabilizing device in accordance with a second embodiment of the present disclosure.
Figure 4B:
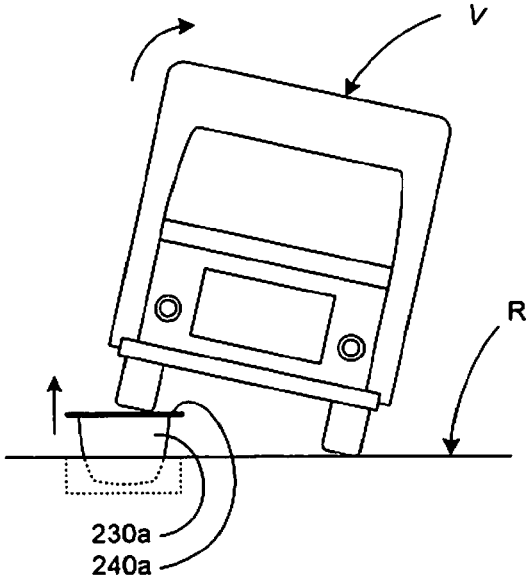
FIG. 4B is a schematic front view illustrating the deployed configuration of the vehicle destabilizing device shown in FIG. 4A.

FIGS. 4A and 4B are schematic side and front views, respectively, illustrating the second or deployed configuration of a vehicle destabilizing device 200 in accordance with a second embodiment of the present disclosure. The vehicle destabilizing device 200 includes one or more lift devices 230 (individual lift devices 230*a* and 230*b* are shown in FIG. 4A) and corresponding lift surfaces 240 (individual lift surfaces 240*a* and 240*b* are shown in FIG. 4A).

As compared to the vehicle destabilizing device 100 shown in FIGS. 3A and 3B, the lift surfaces 240 of the vehicle destabilizing device 200 are not pivoted. Instead, the lift devices 230 elevate the lift surfaces 240 out of the housing 20. Otherwise, the lift devices 230 and lift surfaces 240 are generally similar to the lift device 130 and the ramp 140, respectively, of the vehicle destabilizing device 100.

Figure 5A:
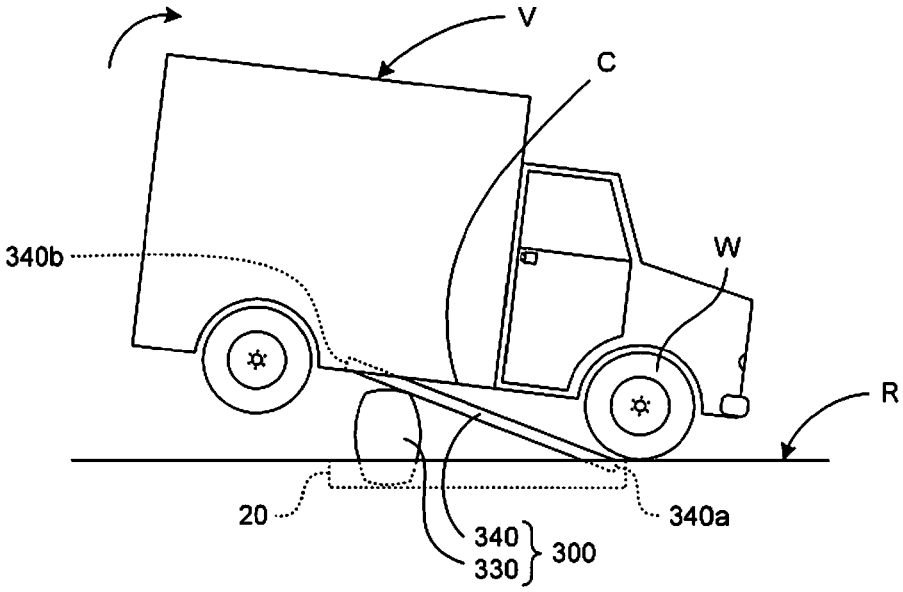
FIG. 5A is a schematic side view illustrating a deployed configuration of a vehicle destabilizing device in accordance with a third embodiment of the present disclosure.
Figure 5B:
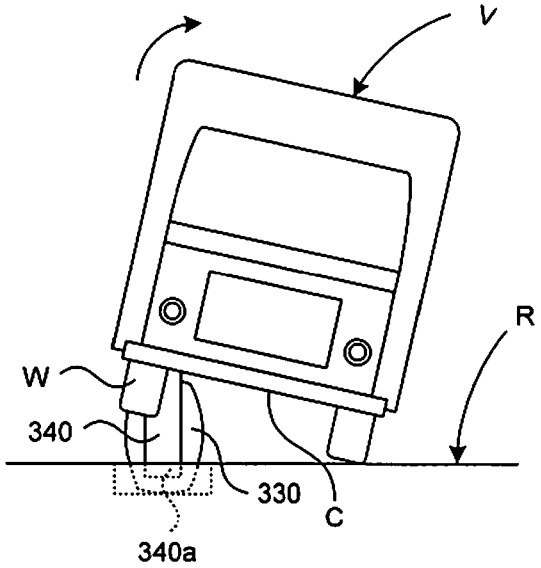
FIG. 5B is a schematic front view illustrating the deployed configuration of the vehicle destabilizing device shown in FIG. 5A.

FIGS. 5A and 5B are schematic side and front views, respectively, illustrating the second or deployed configuration of a vehicle destabilizing device 300 in accordance with a third embodiment of the present disclosure. The vehicle destabilizing device 300 includes a lift device 330 and a ramp 340.

In the embodiment shown in FIGS. 5A and 5B, a lift device 330 raises a leading end 340*b* of the ramp 340, which engages the chassis C of a vehicle V after at least one wheel W has passed over the vehicle destabilizing device 300.

Lift on one side of the vehicle V is created by the forward momentum of the vehicle V in a manner similar to that used during an Olympic pole vault. In the embodiment shown in FIGS. 5A and 5B, the trailing end 340*a* of the ramp 340 is pivotally coupled to the housing 20. Alternatively, the trailing end 340*b* can be freely disposed relative to the housing 20 and ramp 340 can leverage off of the preceding wheel W of the vehicle V to create a fulcrum point. The leading end 340*b*, having been raised by the lift device 330, catches on or otherwise engages the underside, e.g., the chassis C, of the vehicle V. The vaulting action of the ramp 340 lifts one side of the vehicle V and deflects and/or destabilizes the center of gravity of the vehicle V. As with the vehicle destabilizing devices 100 and 200, the vehicle destabilizing device 300 causes the vehicle's forward momentum to be deflected and/or causes the vehicle to tip over or overturn. Otherwise, the lift devices 330 and ramp 340 are generally similar to the lift device 130 and the ramp 140, respectively, of the vehicle destabilizing device 100.

Figure 6:
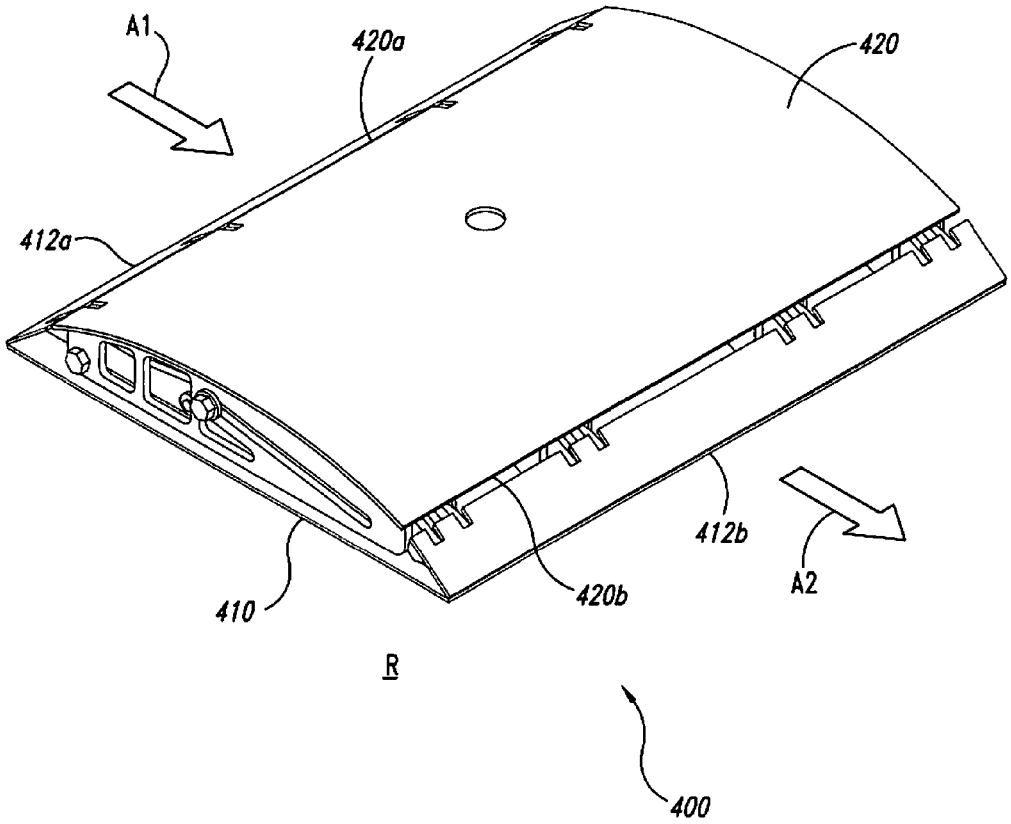
FIG. 6 is a perspective view illustrating a stowed configuration of a vehicle destabilizing device in accordance with a fourth embodiment of the present disclosure.
Figure 7A:
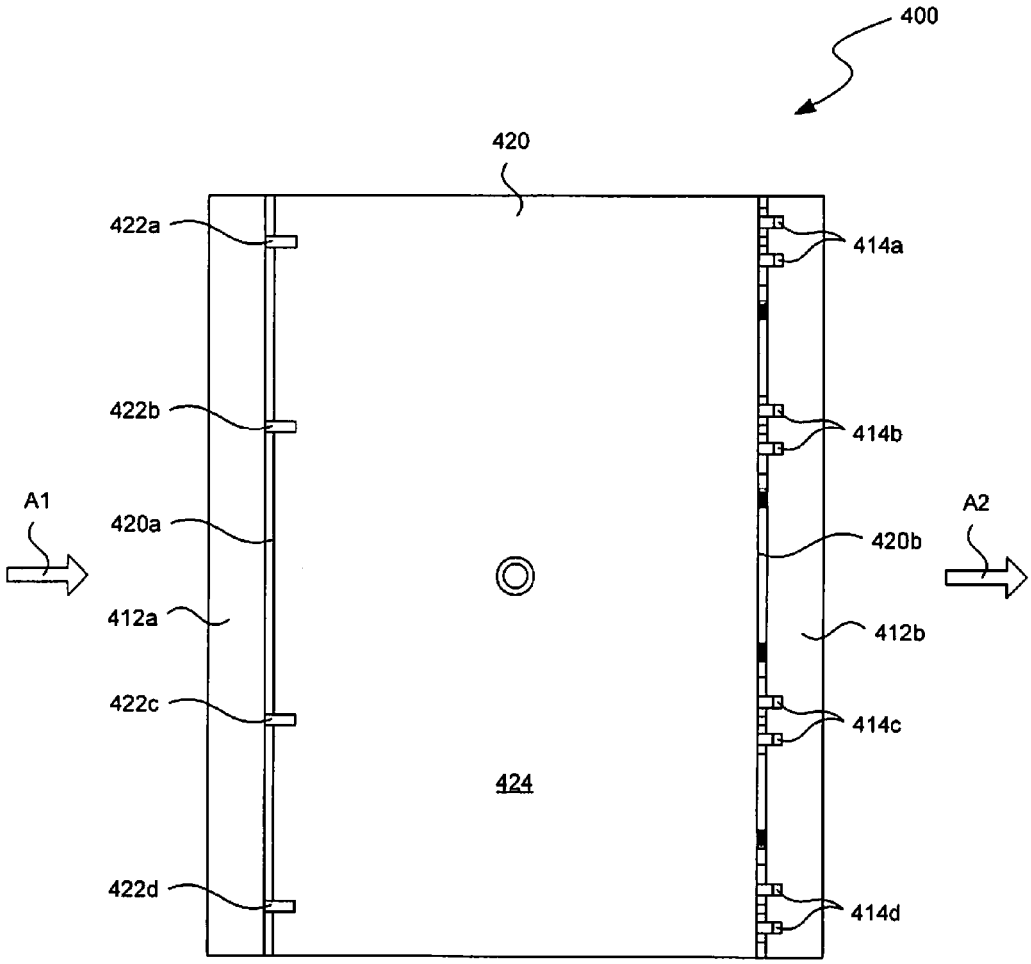
FIG. 7A is a top plan view illustrating the stowed configuration of the vehicle destabilizing device shown in FIG. 6.
Figure 7B:
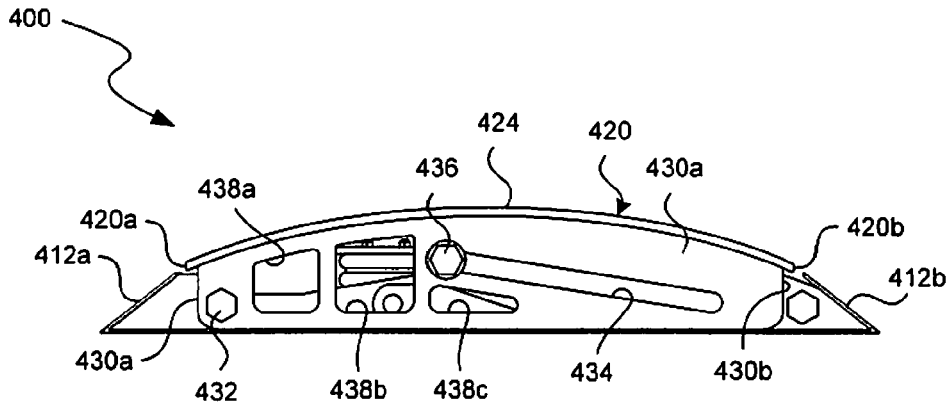
FIG. 7B is a side view illustrating the stowed configuration of the vehicle destabilizing device shown in FIG. 6.

FIGS. 6, 7A and 7B illustrate a stowed configuration of a vehicle destabilizing device 400 in accordance with a fourth embodiment of the present disclosure. The device includes a base or housing 410 that rests on or is otherwise fixed to a road surface R that is in the pathway of a target vehicle (not shown). The housing 410 includes a leading ramp 412*a* and a trailing ramp 412*b* with respect to a direction of vehicle travel indicated with the arrows A1 and A2. The destabilizing device 400 in the stowed configuration as shown in FIG. 6 presents the appearance of a conventional speed bump or speed table to an approaching driver. Accordingly, a non-target vehicle approaching the stowed destabilizing device 400, e.g., arrow A1, initially encounters the leading ramp 412*a*, which leads onto a destabilizing member 420, and then exits off the destabilizing device 400, e.g., arrow A2, via the trailing ramp 412*b*. Accordingly, the destabilizing member 420 may include a ramp that extends between a leading edge 420*a* that is proximate to the leading ramp 412*a* and a trailing edge 420*b* that is proximate to the trailing ramp 412*b*.

Referring additionally to FIG. 7A, the destabilizing member 420 may include a plurality of notches 422 (individual notches 422*a-d* are shown in FIG. 7A) in the leading edge 420*a*. FIG. 7A also shows that the trailing ramp 412*a* may include a plurality of notch pairs 414 (individual notch pairs 414*a-d* are shown in FIG. 7A). As will be further described below, the notches 422 and the notch pairs 414 receive various links in the deployed configuration of the destabilizing device 400.

Referring to FIGS. 6 and 7B, the destabilizing member 420 may include a convex surface 424. The surface 424 may provide a smooth transition from the leading ramp 412*a* to the trailing ramp 412*b* when a wheel of a non-target vehicle rolls over the destabilizing device 400. In other embodiments, the surface 424 may be flat, a combination of convex and flat contours, or any contour that is suitable for leading from the leading ramp 412*a* to the trailing ramp 412*b* in the stowed configuration of the destabilizing device 400. The surface 424 may be protected with a coating, e.g., paint or plastic, to protect the surface 424

A plurality of webs 430 (only one web 430*a* is shown in FIGS. 6 and 7B) may reinforce the contour of the surface 424. Each web 430 may extend between a leading end 430*a* that is proximate to the leading ramp 412*a* and a trailing end 430*b* that is proximate to the trailing ramp 412*b*. The leading end 430*a* may be pivotally disposed with respect to the housing 410. For example, one or more pivot pins 432 may pivotally couple the webs 430 to the housing 410 as will be further described below. Individual webs 430 may also include a slot 434 extending from approximately a midpoint of the web 430 toward the trailing end 430*b*. As will be further described below, each slot 434 receives a sliding pin 436 of a cooperating linkage. Each web 430 may also include one or more additional openings 438 (individual openings 438*ba-c* are shown in FIG. 7B) to reduce the weight without adversely affecting the strength of the web 430.

Figure 9A:
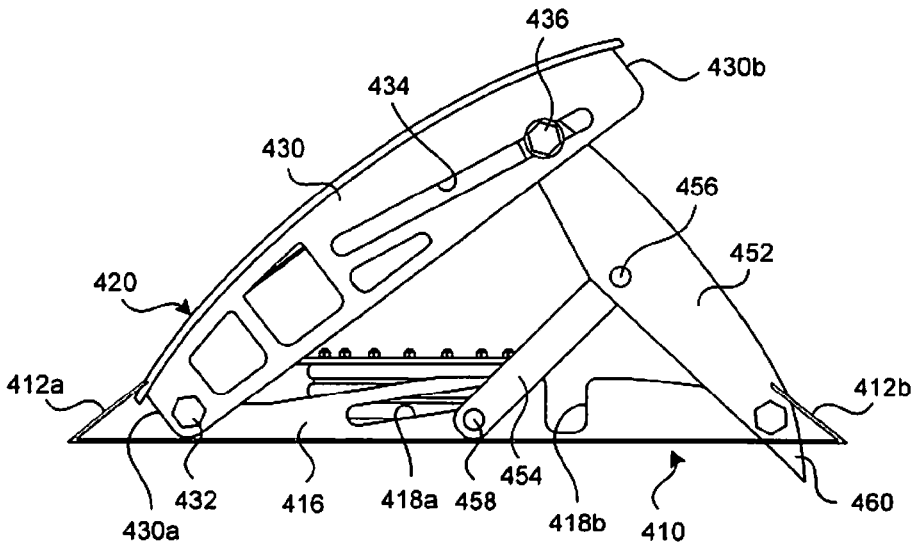
FIG. 9A is a side view illustrating the deployed configuration of the vehicle destabilizing device shown in FIG. 6.
Figure 8:
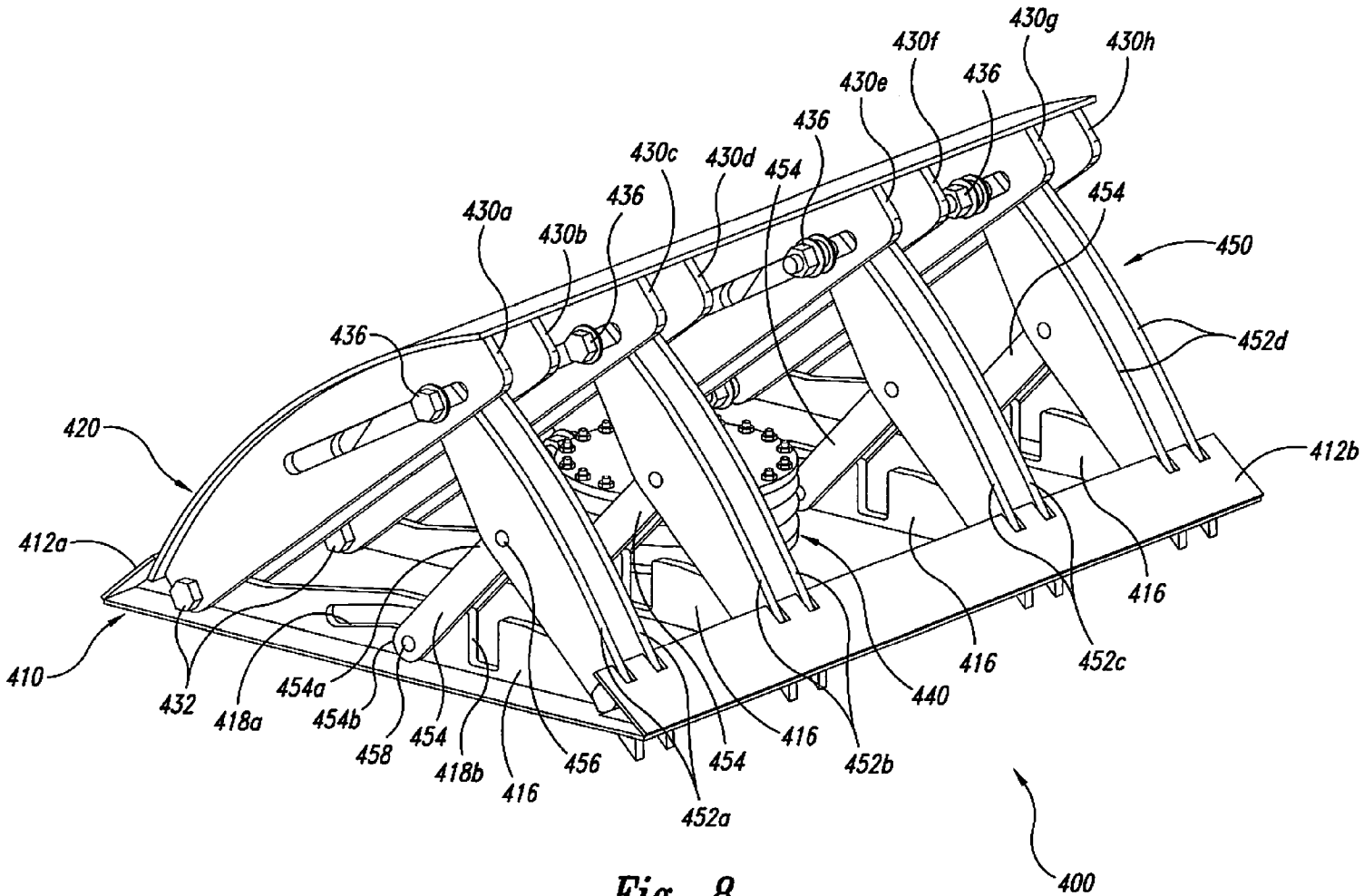
FIG. 8 is a perspective view illustrating a deployed configuration of the vehicle destabilizing device shown in FIG. 6.
Figure 9B:
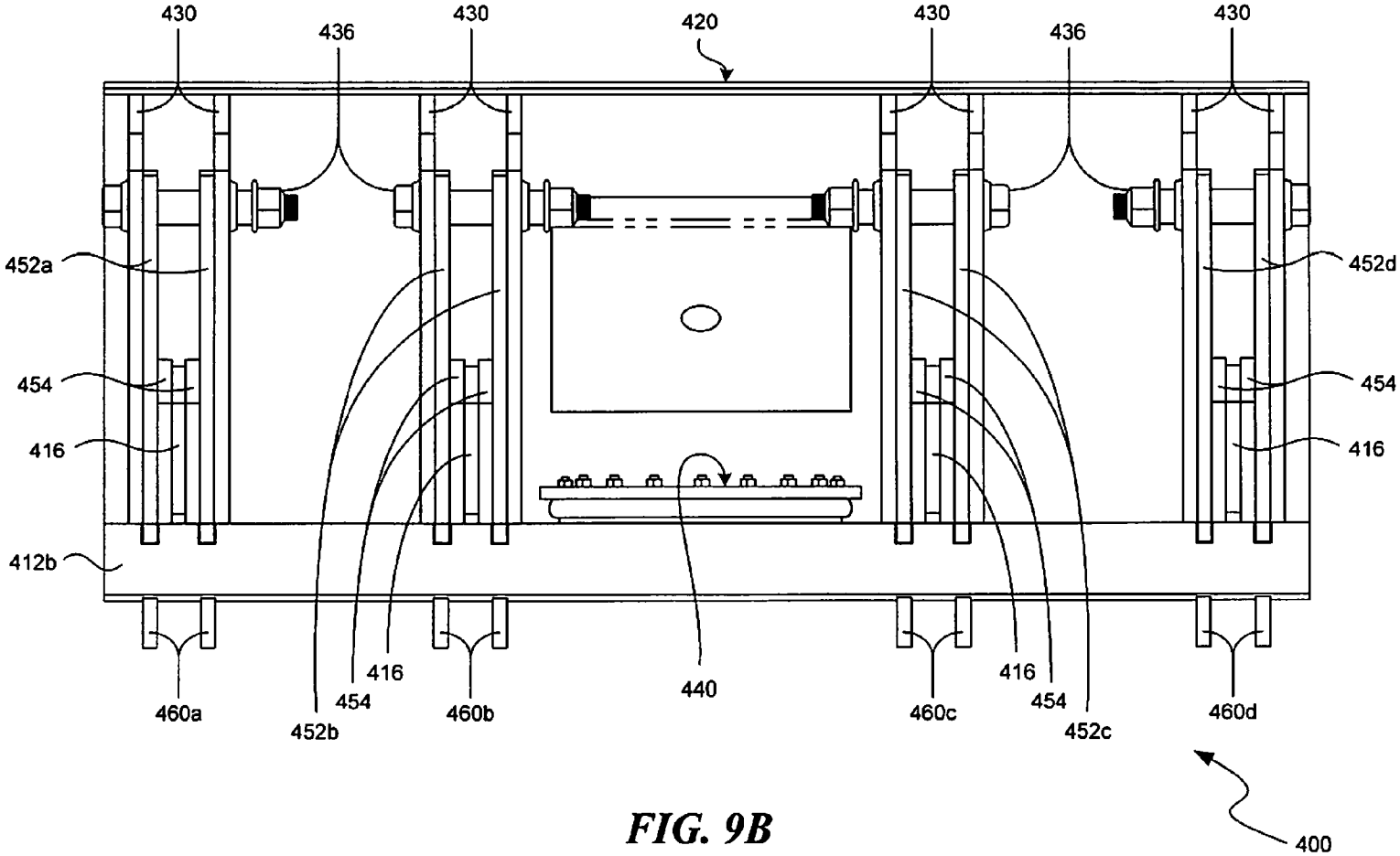
FIG. 9B is a back view illustrating the deployed configuration of the vehicle destabilizing device shown in FIG. 6.

FIGS. 8, 9A and 9B illustrate a deployed configuration of the vehicle destabilizing device 400. A lifting device 440 as further described below elevates the destabilizing member 420 to an inclined arrangement. As shown in FIGS. 8 and 9A, the pins 432 pivotally couple the webs 430 to flanges 416, which are coupled to the housing 410. The flanges 416 extend between and support the leading and trailing ramps 412*a* and 412*b*. Each flange 416 includes an "L" shaped lock slot 418*a* and a cutout 418*b* as will be further described below. The flanges 416 are received in the notches 422 in the inclined arrangement of the destabilizing member 420.

A locking device 450 includes pairs of support links 452 (individual pairs of support links 452*a-d* are shown in FIGS. 8 and 9B) and pairs of lock links 454 (four pairs of lock links 454 are shown in FIGS. 8 and 9B). Each pair of support links 452 is pivotally coupled to a corresponding flange 416 proximate to the trailing ramp 412*b* and is slidingly coupled to a corresponding web 430. The pairs of support links 452 are slidingly coupled to the webs 430 via the sliding pins 436 and the slots 434. The pairs of support links 452 may be received in the notch pairs 414 of the trailing ramp 412*b* when the pairs of support links 452 are in an erected arrangement.

Each pair of lock links 454 extends between a first end 454*a* and a second end 454*b*. The first ends 454*a* are pivotally coupled by link pins 456 (only one link pin is indicated in FIG. 8) at approximately a midpoint along a corresponding pair of support links 452. The second ends 454*b* are slidingly coupled to a corresponding flange 416 via lock pins 458 (only one lock pin 458 is indicated in FIGS. 8 and 9A), which extend through a correspond lock slots 418*a*.

Referring now to FIGS. 6-9B, the destabilizing device 400 in the stowed configuration includes: (a) the destabilizing member 420 is pivotally supported with respect to the housing 410 by the pins 432 such that the trailing edge 420*b* and the trailing end 430*b* of the webs 430 are proximate to the trailing ramp 412*b;* (b) the sliding pins 436 are in the slots 434 generally proximate to the midpoints of the webs 430 and the link pins 456 are received in the cutouts 418*a* in the flanges 416; and (c) the lock pins 458 are near or at ends of the longer branches of the lock slots 418*a*. The destabilizing device 400 in the deployed configuration includes: (a) the destabilizing member 420 inclined with respect to the housing 410 such that the trailing edge 420*b* and the trailing end 430*b* of the webs 430 are pivoted away from the trailing ramp 412*b*; (b) the sliding pins 436 have moved in the slots 434 to generally proximate to the trailing end 430*b* of the webs 430; and (c) the lock pins 458 are in the shorter branches of the lock slots 418*a*. Thus, the lifting device 440 raises the destabilizing member 420 from an approximately horizontal position to the inclined arrangement and also erects the pairs of support links 452 from an approximately horizontal position. This lifting and erecting may occur in less than 250 milliseconds, e.g., in approximately 100 milliseconds or less. As the pairs of support links 452 are erected, the pairs of lock links 454 draw the lock pins 458 along the length of the longer branches of the lock slots 418*a* until the lock pins 458 drop into the shorter branches of the lock slots 418*a*. Accordingly, dropping the lock pins 458 in the shorter branches of the lock slots 418*a* secure the pairs of support links 452 in an erected arrangement, which secures the destabilizing member 420 in the inclined arrangement.

As best seen in FIGS. 9A and 9B, erecting the pairs of support links 452 may also cause pairs of spikes 460 (individual pairs of spikes 460*a*-*d* are shown in FIG. 9B) to project downward from the housing 410. These pairs of spikes 460 may embed in the road surface R to avoid or prevent movement of the destabilizing device 400 with respect to the road surface R when a target vehicle engages the destabilizing device 400 in the deployed configuration.

Referring to FIG. 9B, corresponding flanges 416, pairs of lock links 454, pairs of support links 452, and pairs of webs 430 are nested together in a group. Four of these groups are shown distributed between the housing 410 and the destabilizing member 420; however, it is envisioned that the destabilizing device 400 may include more or less groups that can be regularly, symmetrically, or asymmetrically distributed. Although pairs of lock links, support links, and webs are described for each group, it is also envisioned that each group could have single, triple, quadruple, etc. lock links, support links, and webs. Further, each group may include more than one flange. In the stowed configuration shown in FIGS. 6, 7A and 7B, each group consists of a single flange 416 horizontally nested within a pair of lock links 454, which are horizontally nested within a pair of support links 452, which are horizontally nested within a pair of webs 430. Nesting horizontally, or at least approximately horizontally, may reduce the overall height of the destabilizing device 400 in the stowed configuration.

Certain embodiments according to the present disclosure can control the deployment movement of the destabilizing device 400, e.g., control the speed at which the destabilizing member 420 moves between the stowed and deployed configurations. For example, it may be desirable to slow the speed that the destabilizing member 420 moves as it is approaches the deployed configuration, thus reducing the momentum of the destabilizing member 420 and reducing a counter force for positioning the destabilizing device 400 with respect to the road surface R. Accordingly, it may be possible to reduce the number and/or size of stakes fixing the housing 410 to the road surface R. The shape, position, and/or angular orientation of the slots 434 in the webs 430 may control the deployment of the destabilizing device 400. For example, the force required to erect the pairs of support links 452 may increase as the destabilizing member 420 approaches the inclined arrangement. This may be caused by varying the relative angle between the slots 434 and the arcuate paths of the sliding pins 436 as set by the length of the pairs of support links 452. Additionally or alternatively, the width of the slot 434 may taper so as to increasing the relative friction between the slots 434 and the sliding pins 436 as the pairs of support links 452 approach the erected arrangement.

Certain other embodiments according to the present disclosure may have different devices and/or mechanisms for locking the destabilizing member 420 in the inclined arrangement or for controlling the movement of the destabilizing member 420. For example, a telescopically nested group of posts may be pivotally coupled at opposite ends to the destabilizing member 420 and the housing 410. The extent to which the group of posts can be telescopically expanded may of set, e.g., by spring biased locking members, to fix one post to a telescopically adjacent post. Friction members placed between telescopically adjacent posts can be deformed or cause the posts to be deformed for controlling the movement of the destabilizing member 420.

Figure 10:
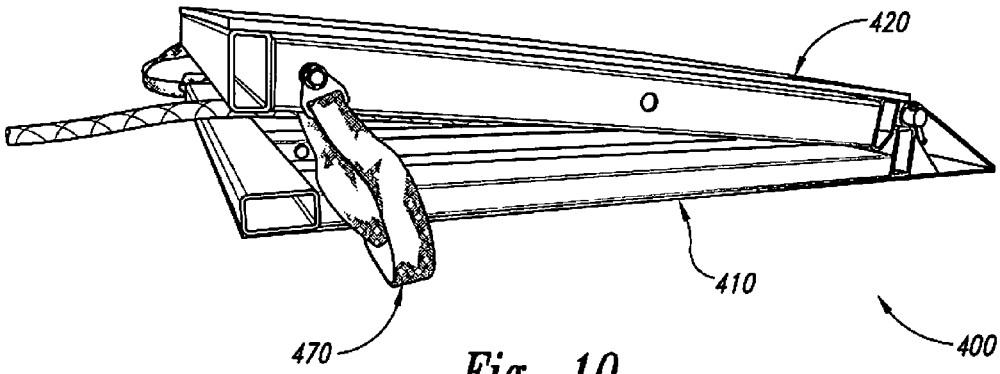
FIG. 10 is a perspective view illustrating an example of a deployment limiter for the vehicle destabilizing device shown in FIG. 6.

FIG. 10 shows a strap 470 coupled to the destabilizing member 420 and the housing 410. The strap 470 may limit a distance that the destabilizing member 420 can travel with respect to the housing 410. Further, the elastic properties of the strap 470 can be selected to control the movement of the destabilizing member 420 at the limit of its travel with respect to the housing 410. Additionally or alternatively, folds of the strap 470 can be sewn together with rip stitches to control the movement of the destabilizing member 420 with respect to the housing 410. Varying the size of the folds and/or the force required to burst the rip stitches can vary the control along the travel of the destabilizing member 420 with respect to the housing 410.

Figure 11A:
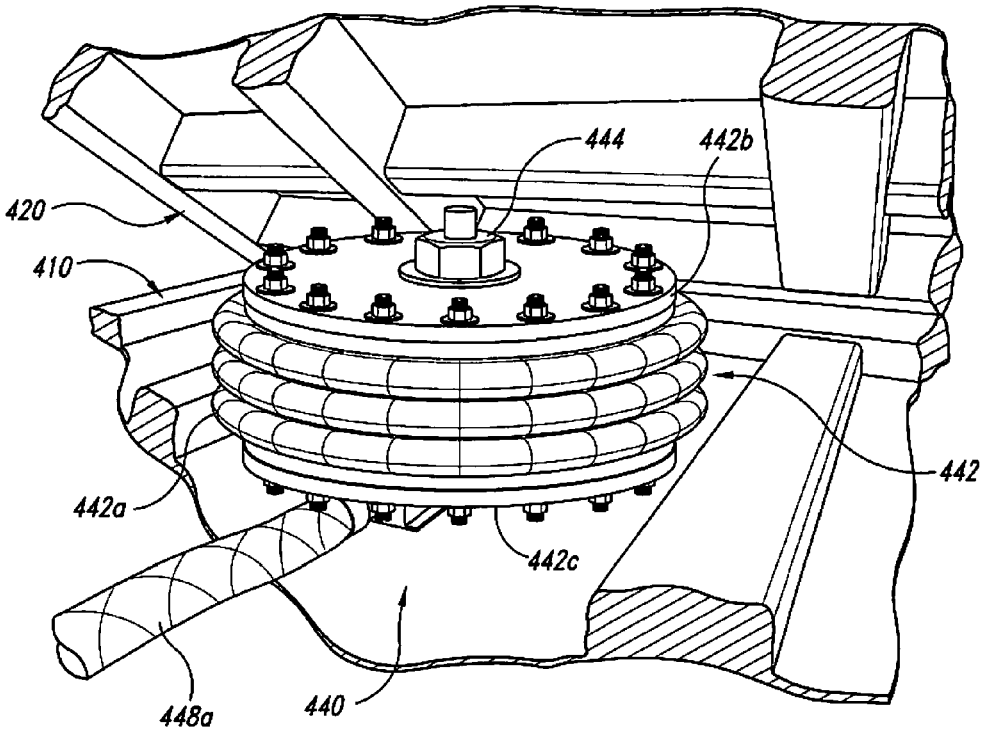
FIG. 11A is a perspective view illustrating a detail of the vehicle destabilizing device shown in FIG. 6.
Figure 11B:
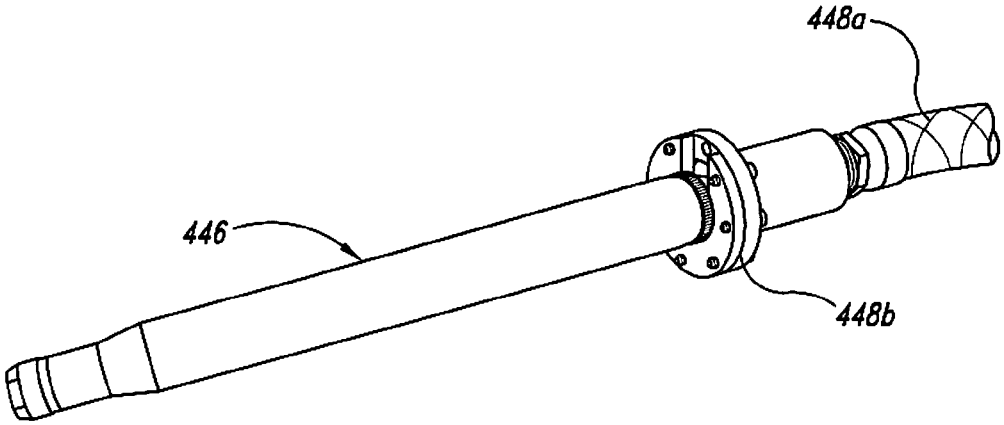
FIG. 11B is a perspective view illustrating an example of an air spring for the vehicle destabilizing device shown in FIG. 6.
Figure 11C:
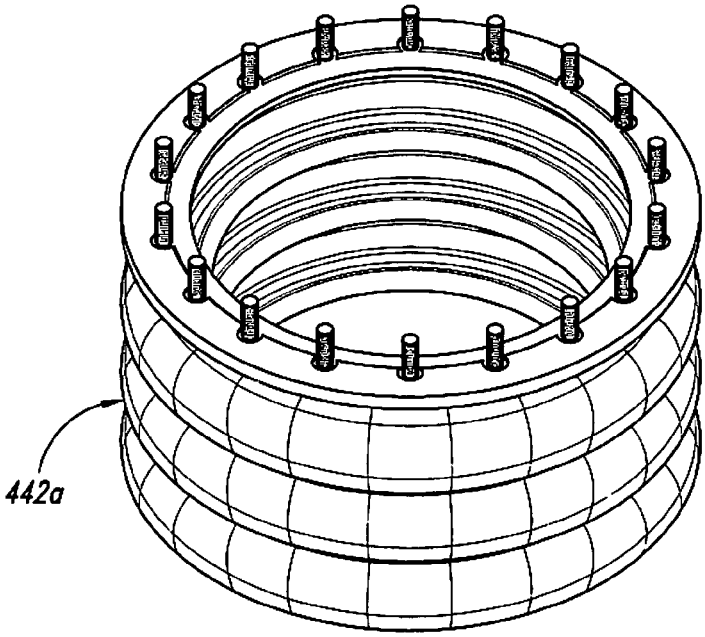
FIG. 11C is a perspective view illustrating an example of a cold gas supply for the vehicle destabilizing device shown in FIG. 6.

FIGS. 11A-11C illustrate details of the lifting device 440 for the vehicle destabilizing device 400. The lifting device 440 shown in FIG. 11A and 11B includes a gas spring 442 coupled to a gas supply 446. Referring additionally to FIG. 11C, the gas spring 442 can include a bladder 442*a* fixed between a top plate 442*b* and a bottom plate 442*c*. One example of a suitable bladder 442*a* is a triple convoluted bladder (part number YI-FT 960-34-761) manufactured by Enidine USA of Orchard Park, N.Y. The top plate 442*b* may include a fixture 444 to contact or to be coupled with the destabilizing member 420. The bottom plate 442*c* may provide a fluid coupling between the inside of the bladder 442*a* and the gas supply 446. The gas supply 446 can include a cold gas supply, e.g., a pressurized air tank, coupled for fluid communication with the bottom plate 442*c* via a conduit 448*a* and a valve 448*b*. The valve 448*b* can include a normally closed, pyrotechnically opened valve for rapidly inflating the gas spring 442. The bladder 442*a* can also include a pressure relief valve (not shown) that may vent pressure from the bladder 442*a* at such time as the lifting device 440 has completing deployment, e.g., the destabilizing member 420 is locked in the inclined arrangement by the locking device 450.

Certain embodiments according to the present disclosure can lift the destabilizing member 420 with devices that use one or more bladders, bladders having different arrangements, shapes or sizes, and/or one or more gas supplies including different fluids or a gas generator. Additionally, pyrotechnical, hydraulic, electrical or mechanical devices can be used together with and/or in lieu of the lifting device 440.

A method according to embodiments of the present disclosure for implementing a vehicle destabilizing device will now be described. A vehicle destabilizing device 100, 200, 300 or 400 can be positioned in a "decision zone" that can be positioned prior to a "stop zone" at a checkpoint, an entry gate, or any other location at which it is desirable to screen vehicle traffic. A vehicle approaching the location would typically slow to allow security personnel manning the location to have an opportunity to investigate the vehicle as it comes to a stop in the decision zone. A friendly vehicle is typically allowed to pass through the decision zone and bypass the stop zone. In the event that a vehicle does not halt for investigation in the decision zone, the security personnel can selectively arm the vehicle destabilizing device 100, 200, 300 or 400 such that prior to the vehicle rolling over the vehicle destabilizing device 100, 200, 300 or 400, the sensor 50 will initiate deploying the vehicle destabilizing device 100, 200, 300 or 400. As the target vehicle approaches the vehicle destabilizing devices 100, or the target vehicle rolls over the vehicle destabilizing devices 200 or 300, the lifting devices 130, 230 or 330 are actuated such that the ramp 140 raises a wheel W, the lift surface 240 elevates a wheel W, or the ramp 340 vaults the chassis C. Similarly, as a target vehicle approaches the vehicle destabilizing device 400, the lifting device 440 lifts and then the locking device 450 locks the destabilizing member 420 in the inclined arrangement for launching a wheel W. The inclined arrangement may include an angle of inclination with respect to the road surface R of between approximately 25 degrees and approximately 45 degrees, e.g., approximately 36.5 degrees. Upward motion acting on the chassis and/or one or more wheels on one side of the vehicle throws off the center of gravity of the vehicle, and the vehicle's forward motion is deflected and/or the vehicle is overturned. Moreover, the upward motion and/or subsequent return of a target vehicle to the road surface may be likely to damage the vehicle, e.g., bend or break the suspension, such that the vehicle is not serviceable to continue moving.

According to the present disclosure, several embodiments can include a vehicle destabilizing device that is packaged in the form of or housed in a portable speed-bump that is meant to be positioned in the path of traffic at a selective location or pathway of traffic. The speed bump can be used to slow down traffic and, unbeknownst to an operator of a target vehicle, the vehicle destabilizing device can arrest the forward movement of the target vehicle. The vehicle destabilizing device can include one or more sections, e.g., each four feet wide, position side-to-side for extending partially or entirely across a road surface of any width.

According to the present disclosure, several embodiments of a vehicle destabilizing device can be remotely armed in anticipation of a target vehicle. As the target vehicle approaches the vehicle destabilizing device, the lifting device can be deployed to initiate a series of destabilizing events. Else, the vehicle destabilizing device can also be remotely disarmed prior to a non-target vehicle reaching the vehicle destabilizing device. Once disarmed, the vehicle destabilizing device can serve back as a conventional speed-bump for merely slowing traffic.

According to the present disclosure, several embodiments of the vehicle destabilizing device can also be permanently or semi-permanently housed at or below the road surface on a drive way or pathway and remotely or directly activated in according to an aforementioned manner. Multiple vehicle destabilizing devices can be placed in sequence to overturn large vehicles.

Vehicle destabilizing devices in accordance with several embodiments of the present disclosure may be used in conjunction with preceding speed bumps or speed dots that aid in disrupting forward motion of a vehicle by upsetting the vehicle before it reaches the destabilizing device.

Additional embodiments according to the present disclosure can include batteries or solar cells to provide electrical power for the vehicle destabilizing device, indicators for the state of the battery charge and whether the vehicle destabilizing device has been armed, self diagnostics to evaluate the operability of the vehicle destabilizing device, and wireless or wired controllers for remotely arming of the vehicle destabilizing device from a suitable distance. Moreover, embodiments according to the present disclosure can include reinforcements to withstand heavy vehicles passing over the vehicle destabilizing device or can include features for protecting the vehicle destabilizing device from exposure to various environments such as water or sand.

From the foregoing, it will be appreciated that specific embodiments of the invention have been described herein for purposes of illustration, but that various modifications can be made without deviating from the spirit and scope of the invention. Accordingly, the invention is not limited by the specific embodiments.

What is claimed is:

1. An apparatus to affect forward movement of the vehicle on a surface, the vehicle including a wheel and a chassis, the apparatus comprising:

a destabilizing member having a first stowed configuration and a second deployed configuration;

a lifting device configured to lift the destabilizing member from the first configuration to the second configuration under a vehicle in motion in a period of time and with a sufficient amount of force to destabilize the vehicle in motion; and a lock configured to lock the destabilizing member in the deployed configuration, the lock further comprising:

a first link extending between the housing and the destabilizing member; and a second link extending between the housing and the first link, wherein the first link is pivotally coupled to the housing and slidingly coupled to the destabilizing member; and the second link is pivotally coupled to the first link and slidingly coupled to the housing.

2. The apparatus according to claim 1 wherein the lifting device comprises at least one of a piston actuator, an inflatable actuator, a hydraulic actuator, a pneumatic actuator, and an energetic actuator.

3. The apparatus according to claim 1 wherein the lifting device comprises a gas source, a gas spring, and a valve coupling the gas source with the gas spring; and wherein the stowed configuration includes the valve closed and the gas spring deflated, and the deployed configuration includes the valve open and the gas spring inflated.

4. The apparatus according to claim 1, wherein the period of time is approximately 30 milliseconds.

5. The apparatus according to claim 1, wherein the vehicle is moving at approximately 50-to-60 miles per hour and the amount of force is approximately 30tons.

6. The apparatus according to claim 1 wherein the destabilizing member comprises a convex surface that is configured for the wheel to roll on.

7. The apparatus according to claim 1 wherein the ramp is configured to launch the wheel upward when the ramp is inclined with respect to the surface by the lifting device.

8. An apparatus for shifting a center of gravity of a moving vehicle to affect forward movement of the vehicle on a surface, the vehicle including a wheel and a chassis, the apparatus comprising:

a housing configured to be positioned in a path of the vehicle;

a destabilizing member being deployed from the housing, the destabilizing member being configured to lift one side of the vehicle;

a lifting device configured to lift the destabilizing member with respect to the housing; and a lock configured to lock the destabilizing member in a deployed arrangement with respect to the housing, the lock including— a first link extending between the housing and the destabilizing member, the first link having a spike configured to embed in the surface in the deployed arrangement of the destabilizing member; and a second link extending between the housing and the first link.

9. An apparatus for shifting a center of gravity of a moving vehicle to affect forward movement of the vehicle on a surface, the vehicle including a wheel and a chassis, the apparatus comprising:

a housing configured to be positioned in a path of the vehicle;

a destabilizing member being deployed from the housing, the destabilizing member being configured to lift one side of the vehicle vehicle with respect to the other side of the vehicle so as to rapidly shift the center of gravity of the vehicle such that the vehicle becomes destabilized;

a lifting device configured to lift the destabilizing member with respect to the housing; and a housing stabilizing member configured to embed in the surface in a deployed arrangement of the destabilizing member with respect to the housing.

10. A system for providing selective, remotely deployed destabilization of a moving vehicle, the system comprising:

a housing;

a structural member configured to engage the moving vehicle;

a lifting device configured to lift the structural member underneath the vehicle in an amount of time and with an amount of force to lift one side of the vehicle with respect to the other side of the vehicle while the vehicle is in motion so as to rapidly shift the center of gravity of the vehicle such that the vehicle becomes destabilized;

a safe/arm device having— a safe arrangement configured to prevent the lifting device from lifting the structural member with respect to the housing; and an armed arrangement configured to permit the lifting device to lift the structural member with respect to the housing;

a remote deployment device configured to actuate the lifting device to lift the structural member with respect to the housing; and an embedding device configured to embed in the surface in response to actuating the lifting device to lift the structural member with respect to the housing.

11. The apparatus according to claim 10, further comprising a locking device configured to (a) control deployment of the structural member with respect to the housing; and (b) lock the structural member in a deployed arrangement with respect to the housing.

12. The system according to claim 10 wherein the remote deployment device comprises a sensor configured to detect the vehicle when the safe/arm device is in the armed arrangement.

13. A method for affecting forward movement of a vehicle on a surface, the vehicle including a wheel, the method comprising:

raising a ramp underneath the vehicle while the vehicle is in motion to an inclined arrangement with respect to a housing, the ramp including leading and trailing ends with respect to the forward movement of the vehicle, and the leading end being pivotally coupled with respect to the housing;

locking the ramp in the inclined arrangement with respect to the housing;

embedding a housing stabilizing member in a road surface with respect to the housing during deployment, wherein the stabilizing member is configured to prevent movement of the housing during deployment; and shifting a center of gravity of the vehicle, including— launching the wheel of the vehicle up the ramp from the leading end toward the trailing end; and lifting one side of the vehicle while the vehicle is in motion, the one side having the wheel, with respect to the other side of the vehicle so as to rapidly shift the center of gravity of the vehicle such that the vehicle becomes destabilized.

14. The method according to claim 13, further comprising controlling movement of the ramp with respect to the housing during raising the ramp to the inclined arrangement.

15. The method according to claim 14 wherein controlling movement of the ramp comprises controlling a rate of raising the ramp to the inclined arrangement.

* * * * *